US005097560A

United States Patent [19]

Lawrence

[11] Patent Number: 5,097,560

[45] Date of Patent: Mar. 24, 1992

[54] STREET CLEANING AND HERBICIDE APPLICATOR APPARATUS

[76] Inventor: Bobby C. Lawrence, 1022 Crescent, Wichita Falls, Tex. 76305

[21] Appl. No.: 619,401

[22] Filed: Nov. 29, 1990

[51] Int. Cl.[5] ..... E01H 11/00

[52] U.S. Cl. ..... 15/4; 15/83; 15/87; 47/1.5

[58] Field of Search ..... 15/83, 84, 85, 87, 320, 15/340.3, 340.4, 4; 47/1.5

[56] References Cited

U.S. PATENT DOCUMENTS 3,186,016 6/1965 Gehman et al. ..... 15/87

4,160,302 7/1929 Hirst et al. ..... 15/87

*Primary Examiner*—Edward L. Roberts

*Attorney, Agent, or Firm*—Leon Gilden

[57] ABSTRACT

An apparatus wherein a herbicide applicator spray organization is mounted to a self-propelled street cleaning vehicle. The vehicle includes a forward rotary brush and a rear rotary brush, the forward rotary brush and herbicide applicator spray head are mounted to a parallel link support framework. A storage tank delivers the herbicide fluid to the spray head through a pump and valve interconnection.

4 Claims, 3 Drawing Sheets

STREET CLEANING AND HERBICIDE APPLICATOR APPARATUS

BACKGROUND OF THE INVENTION

1. Field of the Invention

The field of invention relates to herbicide applicator apparatus, and more particularly pertains to a new and improved street cleaning and herbicide applicator apparatus wherein the same incorporates a herbicide spray inconjunction with street cleaning to minimize vegetation growth within streets to be cleaned.

2. Description of the Prior Art

Street cleaning organizations have been utilized in the prior art to effect street cleaning, typically by municipalities, of public streets and the like. Such activity is not confined to public service, but such is its typical application. Further, equipment has been available in the prior art to direct herbicidal solutions onto various surfaces for control of such growth, where it is desired in this instance to combine herbicidal application with street cleaning to minimize vegetation growth in street situations and roadways where such growth tends to deteriorate structural integrity of such systems. Examples of prior art herbicidal applicatos may be found for example in U.S. Pat. No. 4,709,505 to Lempa, Jr. wherein a herbicidal tank in association with a pump is mounted onto a farm type tractor for application to an underlying surface.

U.S. Pat. No. 4,748,769 to Kolskog, et al. sets forth a sprayer assembly for liquids mounted upon a portable cart for limiting vegetable growth.

U.S. Pat. No. 4,733,013 to Richardson, et al. sets forth an apparatus for directing liquid to control vegetation for mounting upon a tractor type vehicle.

U.S. Pat. No. 4,467,558 to Rathman sets forth a herbicide applicator for mounting to an all-terrain vehicle to direct herbicidal application to various remote locations.

U.S. Pat. No. 4,426,807 Maddock sets forth a herbicide applicator for mounting on a vehicle utilizing an elongated manifold arrangement directing herbicide application to underlying vegetable growth through various members that conform to an underlying terrain to effect a wiping of the herbicidal solution onto the underlying terrain.

As such, it may be appreciated that there continues to be a need for a new and improved street cleaning and herbicidal applicator apparatus as set forth by the instant invention which addresses the problems of street cleaning in combination with herbicide application and in this respect, the present invention substantially fulfills this need.

SUMMARY OF THE INVENTION

In view of the foregoing disadvantages inherent in the known types of herbicide applicators now present in the prior art, the present invention provides a street cleaning and herbicide applicator apparatus wherein the same sets forth the use of the combination of herbicide application and street cleaning in a single self-propelled vehicle. As such, the general purpose of the present invention, which will be described subsequently in greater detail, is to provide a new and improved street cleaning herbicide applicator apparatus which has all the advantages of the prior art herbicide applicator apparatus and none of the disadvantages.

To attain this, the present invention provides an apparatus wherein a herbicide applicator spray organization is mounted to a self-propelled street cleaning vehicle. The vehicle includes a forward rotary brush and a rear rotary brush, the forward rotary brush and herbicide applicator spray head are mounted to a parallel link support framework. A storage tank delivers the herbicide fluid to the spray head through a pump and valve interconnection.

My invention resides not in any one of these features per se, but rather in the particullar combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basic for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms of phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved street cleaning and herbicide applicator apparatus which has all the advantages of the prior art herbicide applicators and none of the disadvantages.

It is another object of the present invention to provide a new and improved street cleaning and herbicide applicator apparatus which may be easily and efficiently manufactured and marketed.

It is a further object of the present invention to provide a new and improved street cleaning and herbicide applicator apparatus which is of a durable and reliable construction.

An even further object of the present invention is to provide a new and improved street cleaning and herbicide applicator apparatus which is susceptible of a low cost of manufacture with regard to both materials and labor, and which accordingly is then susceptible of low prices of sale to the consuming public, thereby making such street cleaning and herbicide applicator apparatus economically available to the buying public.

Still yet another object of the present invention is to provide a new and improved street cleaning and herbicide applicator apparatus which provides in the apparatuses and methods of the prior art some of the advantages thereof, while simultaneously overcoming some of the disadvantages normally associated therewith.

Still another object of the present invention is to provide a new and improved street cleaning and herbicide applicator apparatus wherein the same conveniently and efficiently mounts a herbicide applicator in conjunction with a self-propelled street cleaning vehicle positioned medially of a forward and rear brush of the street cleaning organization.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
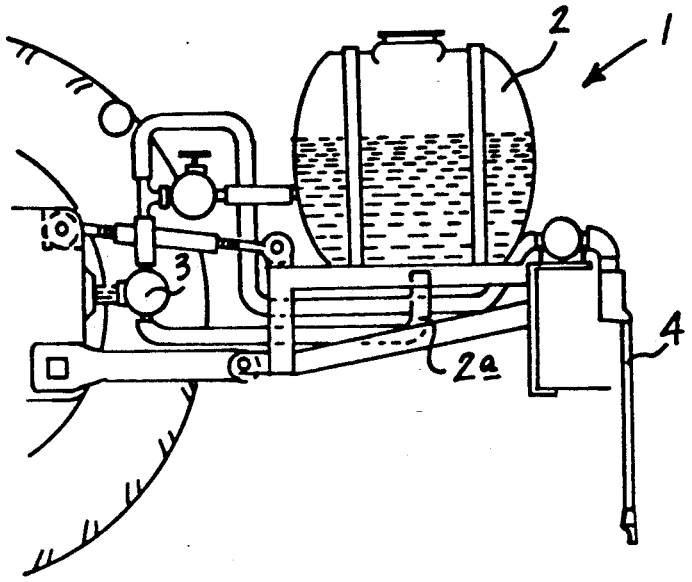
FIG. 1 is an orthographic side view of a prior art herbicide applicator apparatus.

With reference now to the drawings, and in particular to FIGS. 1 to 5 thereof, a new and improved street cleaning and herbicide applicator apparatus embodying the principles and concepts of the present invention and generally designated by the reference numeral 10 will be described.

FIG. 1 illustrates a prior art herbicide applicator apparatus 1, wherein a herbicide tank 2 connects a herbicidal fluid through a conduit 2*a*, wherein a pump 3 directs such fluid through an applicator conduit 4.

More specifically, the street cleaning and herbicide applicator apparatus 10 of the instant invention essentially comprises a self-propelled vehicle 11, including a forward vehicle wheel pair 17 and a rear vehicle wheel pair 18 positioned adjacent the forward wheel pair 17 and between the forward and rear wheel pairs 17 and 18 is a forward rotary cleaning brush 12. A rear rotary cleaning brush 13 is positioned rearwardly of the rear wheel pair 18. A herbicide tank 14 is provided to include a drain opening 15, as well as a fill conduit 15*a*. The fill conduit directs a herbicide liquid into the tank prior to use. The tank is mounted within a vehicle housing 16 overlying the vehicle chassis and the forward and rear wheel pairs. A herbicide delivery conduit 19 is in fluid communication with the herbicide tank 14 and directs the herbicide through an electrical spray head valve 32 to permit fluid to be dispersed through the spray head 20.

Figure 2:
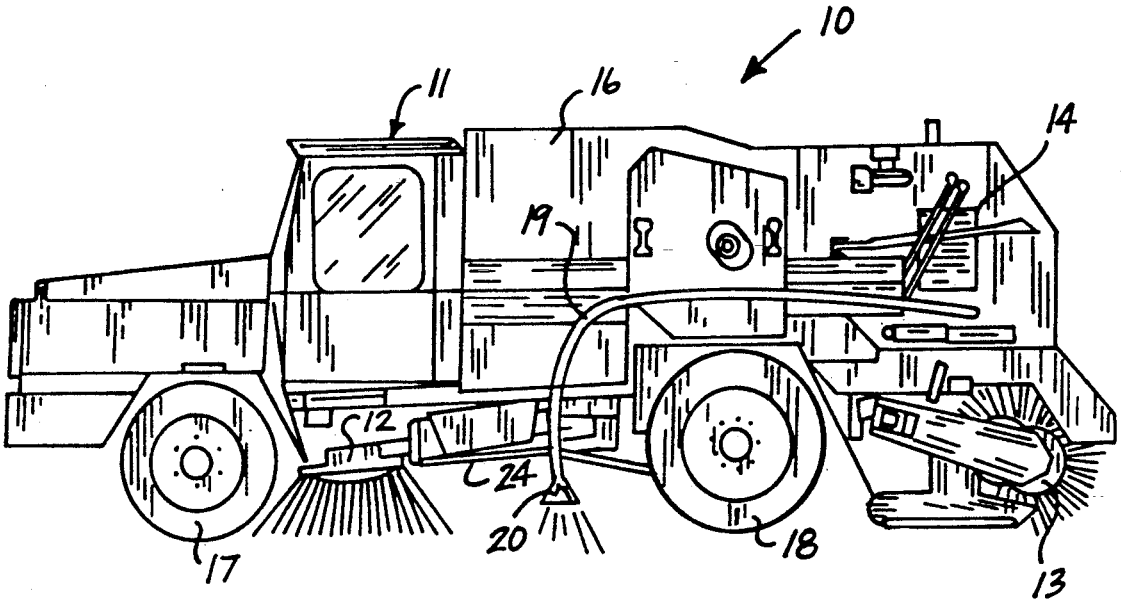
PRIOR ART FIG 2
FIG. 2 is an orthographic side view, taken in elevation, of the self-propelled herbicide and street cleaning vehicle utilized by the instant invention.
Figure 3:
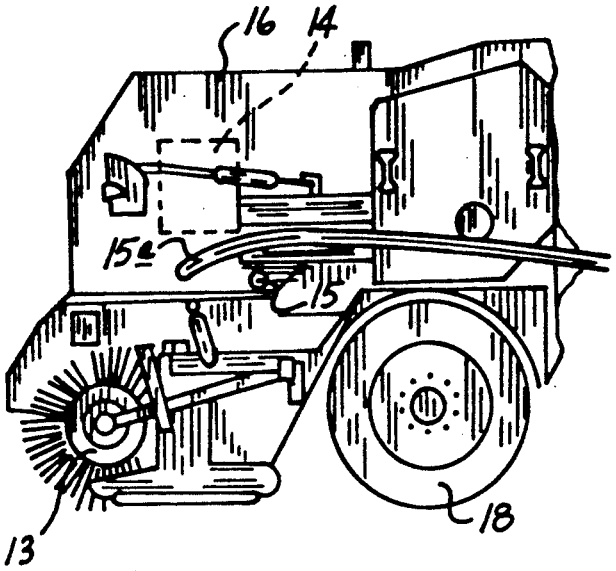
FIG. 3 in an orthographic side view, taken in elevation, of a rear portion of the self-propelled vehicle.
Figure 4:
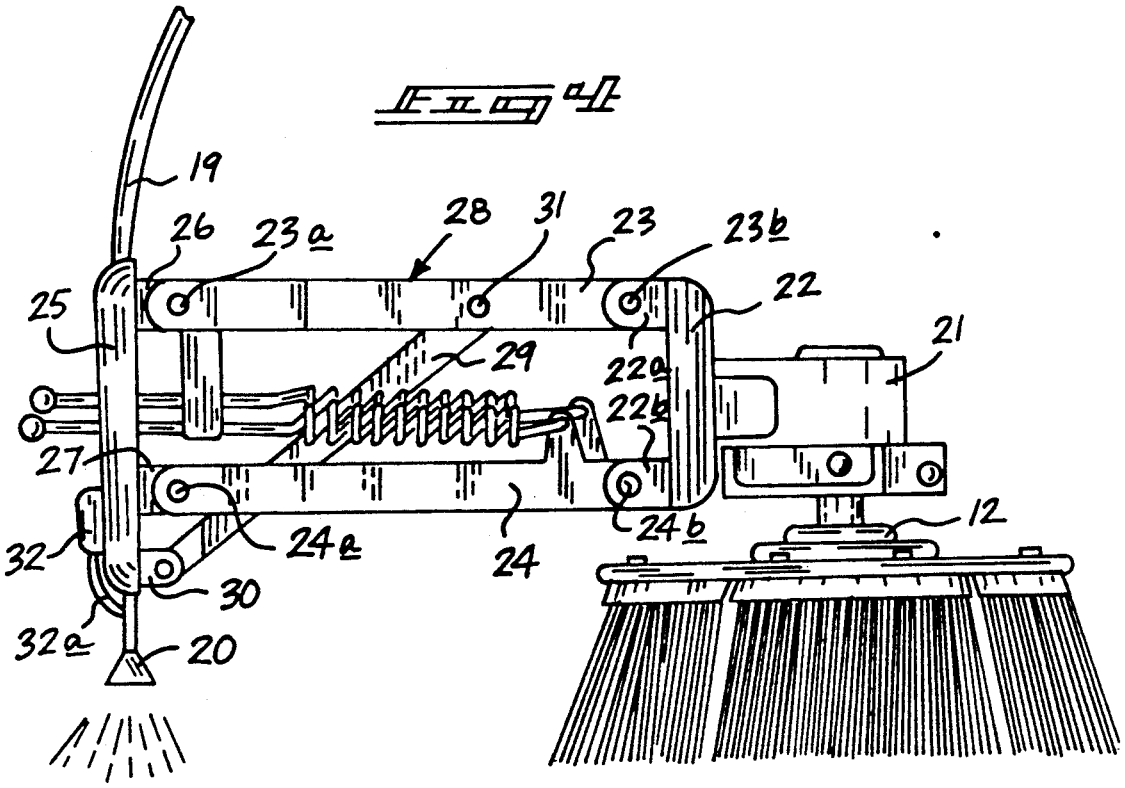
FIG. 4 is an orthographic side view, taken in elevation, of the support leg utilized by the instant invention.
Figure 5:
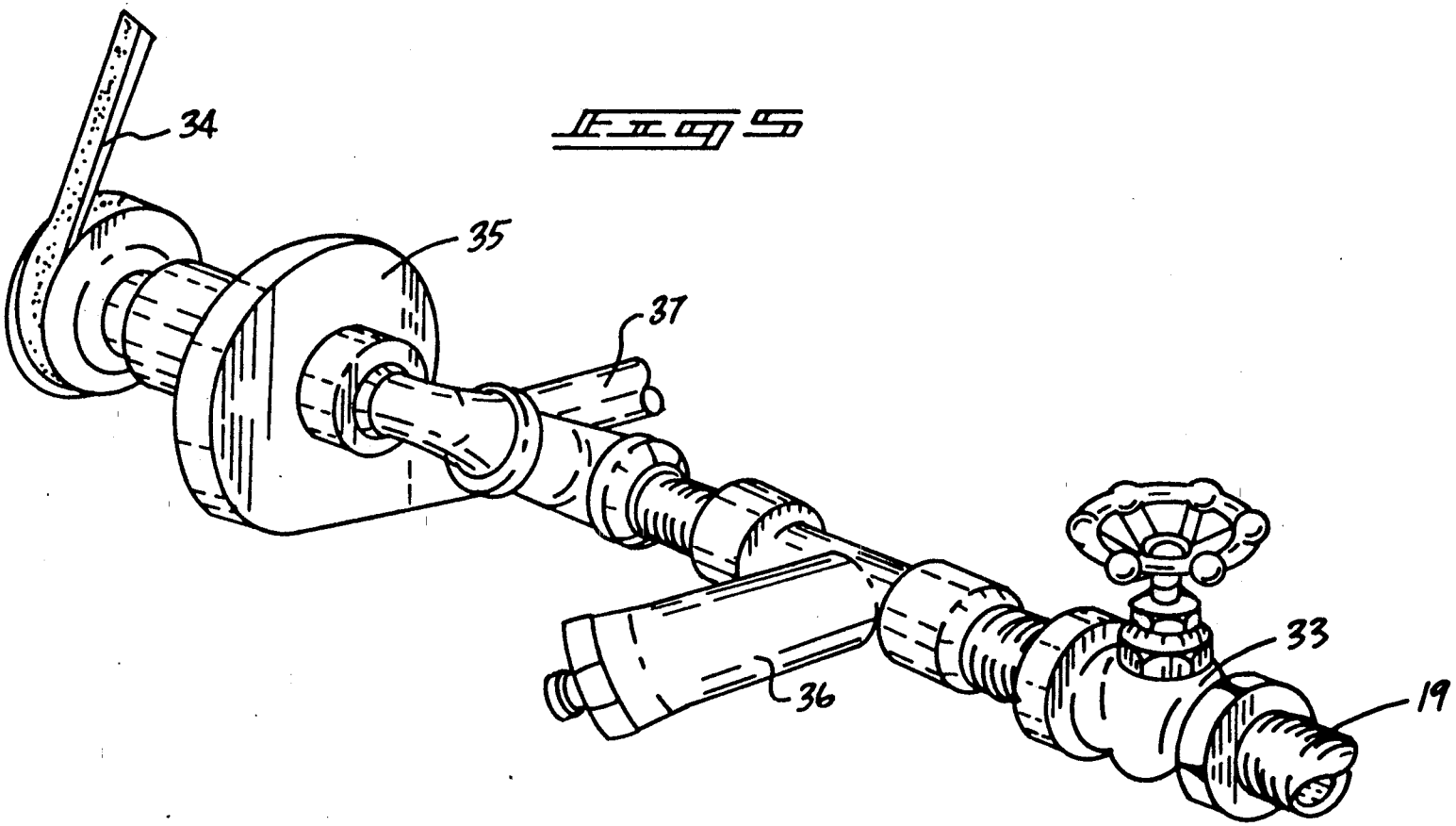
FIG. 5 is an isometric illustration of the valve and drive assembly utilized by the instant invention.

Reference to FIG. 4 illustrates the forward brush 12 and the forward brush drive motor 21 mounted to a forward brush support link 22. The forward brush link 22 includes an upper and lower support link lug 22*a* and 22*b* respectively, with a top first link 23 pivotally mounted to the upper support link lug 22*a* through a first link second pivot 23*b* adjacent a right terminal end of first link, with a lift terminal end of the first link including a first link first pivot 23*a* pivotally mounting the top first link 23 to a herbicide manifold 25. The herbicide manifold 25 includes a manifold top lug 26 and a medial lug 27. The medial lug 27 is pivotally mounted to a bottom second link 24, with a bottom second link first pivot 24*a* pivotally mounted to the medial lug 27, with the second link 24 including a second pivot 24*b* mounted to the lower support link lug 22*b*. The herbicide manifold 25 in fluid communication with the herbicide delivery conduit 19 includes an herbicide manifold bottom lug 30 that mounts a locking link 29 that in turn is releasably mounted to a locking link release pin 31 to secure the parallel link support framework 28 in an operative downward relationship, as illustrated in FIGS. 2 and 4 for example. FIG. 5 illustrates the use of a pump member 35 driven through a drive belt 34 to direct the herbicidal fluid through a conduit valve 33 from a supply conduit 37 directed from the herbicide tank 14. An optional filter 36 is positionable and removable within the housing that is obliquely mounted relative to the herbicidal supply conduit, as illustrated.

In use therefore upon positioning of the parallel link support framework 28 in a lowered position, as illustrated in FIG. 4 to define a generally rectanglular configuration, the forward rotary cleaning brush 12 is in operative association with an underlying surface to be cleaned and permits operative use of the spray head 20 to effect application of an herbicidal spray.

As to the manner of usage an operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be emcompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope to the invention.

What is claimed as being new and desired to be protected by Letters Patent of the United States is as follows:

1. A street cleaning and herbicide applicator apparatus comprising, in combination, a self-propelled vehicle, the self-propelled vehicle including a forward wheel pair and a rear wheel pair, the vehicle further including a vehicular housing overlying a vehicular chassis mounting the forward and rear wheel pair, and a forward rotary cleaning brush mounted between the forward and rear wheel pair, and a rear rotary cleaning brush mounted rearwardly of the rear wheel pair, and the vehicular housing including a herbicide tank, and the herbicide tank including a herbicide delivery conduit in fluid communication with the herbicide tank, and a spray head mounted to the herbicide delivery conduit remote from the herbicide tank, and the spray head positioned rearwardly of the forward rotary brush, and wherein a parallel link support framework is mounted underlying the chassis, and wherein the parallel link support framework mounts the forward brush at a forward end of the parallel link support framework, and mounts the spray head to a rear portion of the parallel link support framework, and wherein the parallel link support framework includes a top first link and a bottom second link, the rotary cleaning brush is mounted to a forward brush support link, the forward brush support link including an upper support link lug and a lower support link lug, the upper support link lug is pivotally mounted to a forward end of the top first link, and the lower support link lug is mounted to a forward end of the bottom second link, and wherein the parallel link support framework further includes an herbicide mainfold in fluid communication between the herbicide delivery conduit and the spray head, the herbicide manifold including a herbicide manifold top lug, with the herbicide manifold top lug pivotally mounted to a rear end portion of the top first link, and the herbicide manifold including a medial lug, wherein the medial lug is pivotally mounted to a rear terminal end of the bottom second link.

2. An apparatus as set forth in claim 1 wherein the herbicide manifold extends below the bottom second link and includes a bottom lug, the bottom lug mounting a locking link at a lower terminal end of the locking link to the bottom lug, and the locking link releasably mounted to the top first link between the herbicide manifold top lug and the forward brush support link upper support link lug.

3. An apparatus as set forth in claim 2 wherein a locking link release pin releasably mounts the locking link to the top first link.

4. An apparatus as set forth in claim 3 wherein the herbicide delivery conduit is in fluid communication with a pump member, the pump member receives fluid from the herbicide tank through a supply delivery conduit, and further including a filter member mounted between the pump member and the herbicide delivery conduit.

* * * * *